United States Patent [19]

Carmichael

[11] Patent Number: 4,683,900

[45] Date of Patent: Aug. 4, 1987

[54] BOAT CANOPY

[76] Inventor: Bruce Carmichael, 750 Madison, Lebanon, Mo. 65536

[21] Appl. No.: 904,456

[22] Filed: Sep. 8, 1986

[51] Int. Cl.[4] ..... E04H 15/06; E04H 15/36; E04H 15/02

[52] U.S. Cl. ..... 135/88; 135/102; 135/904; 114/361

[58] Field of Search ..... 135/88, 102, 904; 114/361

[56] References Cited

U.S. PATENT DOCUMENTS

| | | | |
|---|---|---|---|
| 3,102,547 | 9/1963 | Domina | 135/88 X |
| 3,161,231 | 12/1964 | Dawson et al. | 135/102 X |
| 3,894,765 | 7/1975 | Bourke et al. | 135/904 X |
| 4,091,484 | 5/1978 | Means | 135/904 X |
| 4,093,302 | 6/1978 | Adams | 135/88 X |
| 4,239,247 | 12/1980 | Hinz | 135/102 X |

*Primary Examiner*—J. Karl Bell

*Attorney, Agent, or Firm*—Johnson, Hovey & Williams Schmidt

[57] ABSTRACT

A canopy for use on a vehicle such as a boat, tractor or the like is provided which is collapsable from an upright position to a collapsed position when the canopy strikes an object and which is conveniently detached from the vehicle and configured to a portable carrying position. The canopy preferably includes two U-shaped support members pivotally intercoupled at the ends thereof and adapted for a coupling with the side rails of the vehicle; a tarpaulin spanning the area between the cross bars of the members; and rubber straps coupled with the members and adapted for slidably coupling with the side rails. The canopy is configured so that when it is in an upright position on the vehicle and strikes an object, the canopy will collapse thereby preventing damage to the canopy, the vehicle, or an occupant. The canopy can also be placed in a storage position for convenient carrying.

6 Claims, 8 Drawing Figures

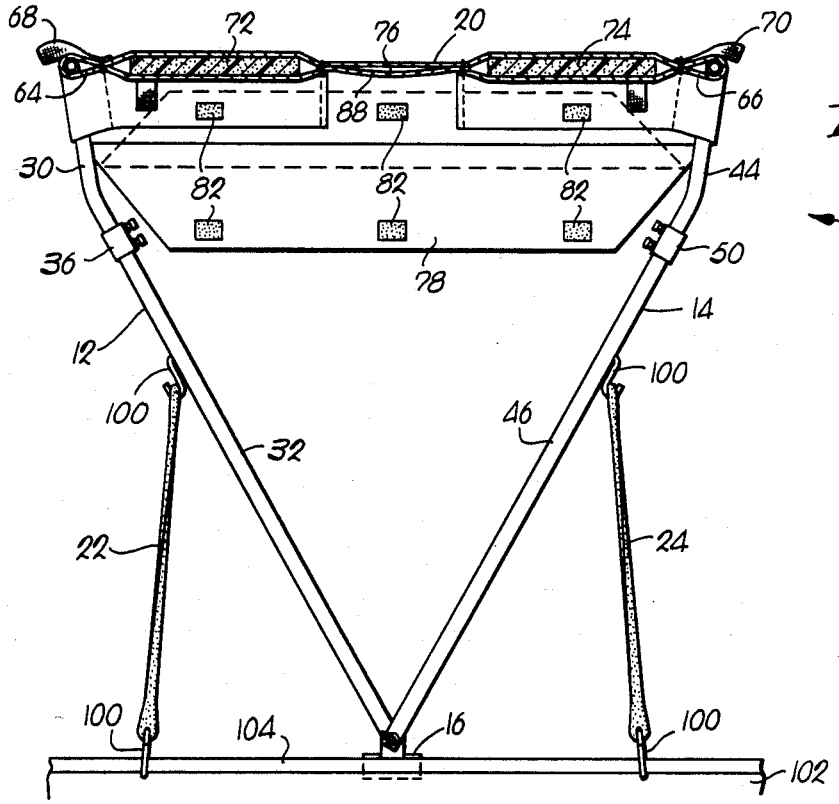
Fig. 2.
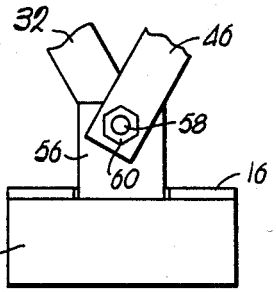
Fig. 5.
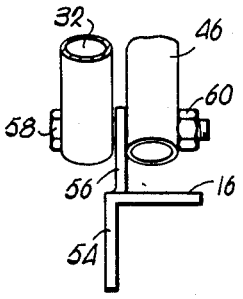
Fig. 6.
Fig. 7.
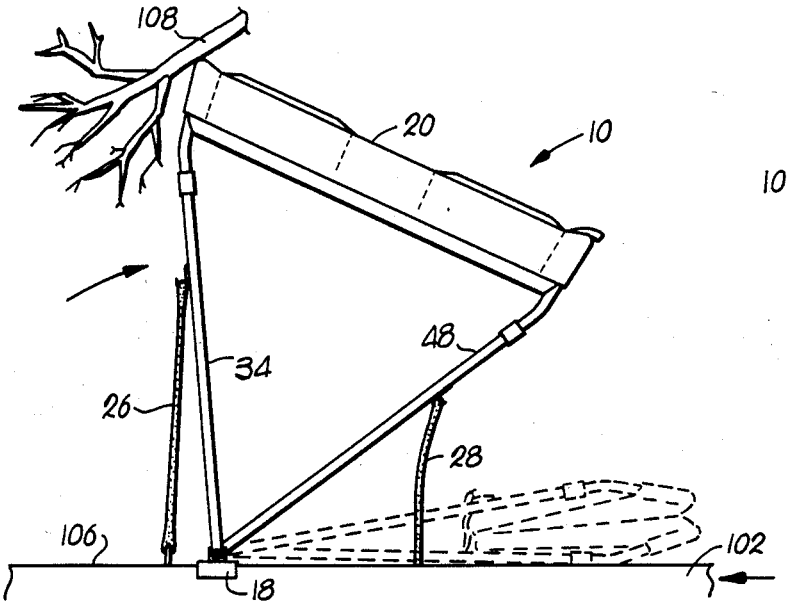
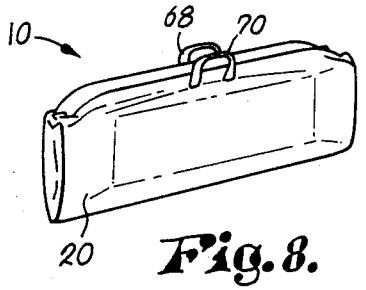
Fig. 8.

BOAT CANOPY

BACKGROUND OF THE INVENTION

1. Field of the Invention

This invention relates to a portable, lightweight, detachable canopy for use on a vehicle such as a boat, tractor, or the like which automatically moves from an upright to a collapsed position upon being struck by an object as when the boat or tractor encounters an overhanging tree branch. This invention also relates to a canopy which can be detached from a vehicle and arranged in a compact portable configuration with a handle for ease in carrying.

2. Description of the Prior Art

Many types of canopies are available for open-topped vehicles such as boats and tractors which are used to prevent exposure of the vehicle occupant to rain or sun. This is particularly important when vehicle occupants are exposed to the elements for substantial lengths of time or when shelter is not nearby.

Known prior art canopies provide various means for attaching a canopy to a vehicle. None of these known canopies, however, provide for automatic collapse of the canopy to prevent damage to itself, the vehicle, or the occupants in the event the canopy is struck by an object. This deficiency is particularly apparent when used on a canoe, for example. Canoists often travel waterways exposed to overhanging tree limbs. Sometimes, canoists cannot avoid passing under tree limbs when a particularly narrow waterway is traveled. In such circumstances, the canopy is subject to being struck by one of these overhanging limbs as the canoe passes underneath. If such an accident occurs, the canopy and the canoe can be damaged and the occupants can be injured, for example, if the canoe is overturned when striking the tree limb.

Additionally, known prior art canopies are not particularly adapted for rapid convenient attachment and detachment of the canopy from the vehicle nor are they particularly adapted for forming their own self contained configuration for easy portability.

SUMMARY OF THE INVENTION

The problems outlined above are solved by the boat canopy hereof. That is to say, the boat canopy is easily attached and detached from a vehicle, automatically and safely collapses when struck by an object, and is easily configurated for convenient portability.

Broadly speaking, the canopy includes two U-shaped support members each having a cross bar and two support legs; first and second coupling means for pivotally intercoupling the first and second legs respectively of each member remote from the cross bars, the coupling means being adapted for coupling with side rails on a vehicle and allowing the cross bars to move alternately between spaced-apart and adjacent positions; a tarpaulin means for intercoupling the bars, for limiting distance the bars may spread apart, and for spanning the area there between; and connecting means including first and second resilient connectors coupled respectively with the first and second members. The connectors are adapted for slidably coupling with the side rails and for being under resilient tension when so coupled.

The canopy is configured for an upright position when used on the vehicle whereby the coupling means are respectively coupled to the side rails of the vehicle, the bars are in a spread apart position with the tarpaulin spanning the area therebetween, the tarpaulin is substantially horizontal relative to the side rails, and the first and second connectors are coupled to the side rails on a opposed sides respectively of the coupling means. The canopy also has a collapsed position when used on the vehicle whereby the first and second coupling means are coupled respectively to the side rails, the cross bars are in the adjacent position, and the support members are resting on the side rails on the same side of the coupling means. The canopy is movable from the upright position to the collapsed position when an object strikes one of the cross bars.

Preferably, the canopy includes four connectors composed of flexible rubber straps. The tarpaulin advantageously includes a flotation means for allowing the canopy to float on water. Additionally, the canopy can be formed into a portable position whereby the tarpaulin is folded, the legs are detached from the cross bars and contained within the folded tarpaulin and a handle is included with the canopy for carrying the canopy in the portable configuration.

BRIEF DESCRIPTION OF THE DRAWINGS

FIG. 2 is an elevational view of the canopy in the upright position;

FIG. 5 is a partial elevational view of the pivotal coupling;

FIG. 6 is an end view of pivotal coupling of FIG. 5;

FIG. 7 is a partial elevational view of the canopy striking an overhanging tree limb with the phantom lines showing the canopy in the collapsed position; and FIG. 8 is a perspective view of the canopy in its folded position.

DESCRIPTION OF THE PREFERRED EMBODIMENT

Figure 1:
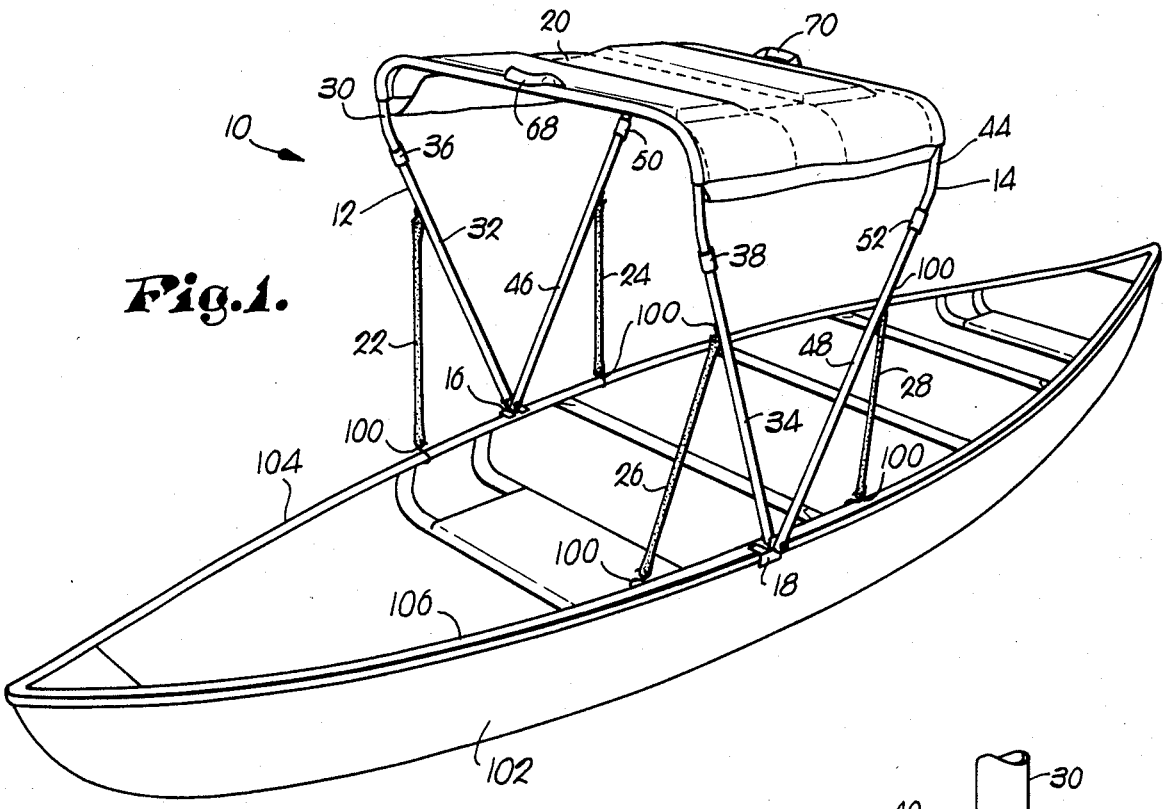
FIG. 1 is a perspective view of the canopy in an upright position attached to a canoe.

Canopy 10 broadly includes U-shaped support members 12 and 14, coupling brackets 16 and 18, tarpaulin 20, and flexible resilient connector straps 22, 24, 26 and 28 (FIGS. 1, 2, and 7).

Support member 12 includes C-shaped tubular cross bar 30, tubular support legs 32 and 34, and support member couplers 36 and 38 all of which are preferably composed of aluminum for lightweight.

Figure 4:
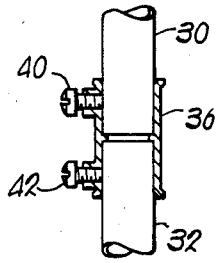
FIG. 4 is a partial elevational view of the coupling between a support leg and a cross bar.

Tubular coupler 36 receives one end of bar 30 and one end of leg 32. Threaded set screws 40 and 42 are threadably received transversely through the side wall of the coupler 36 and respectively engage the ends of leg 30 and leg 32 to rigidly hold them. Coupler 38 similiarly couples the other end of bar 30 and one end of leg 34 and is otherwise identical to coupler 36 as shown in FIG. 4.

Support member 14 includes cross bar 44, support legs 46 and 48, and couplers 50 and 52 all of which are configured identically with the corresponding components of support member 12.

Coupling bracket 16 (FIGS. 5 and 6) includes L-shaped piece 54, vertical extension 56, bolt 58, and nut 60. Bolt 58 is received through appropriate holes (not shown) near the end of leg 32, vertical extension 56, and near the end of leg 46 thus pivotally coupling legs 32 and 46 to bracket 16. Nut 60 is threadably secured on the end of bolt 58 extending through leg 46. Coupling bracket 18 pivotally intercouples legs 34 and 48 and is otherwise identical to bracket 16. As FIG. 1 illustrates, the horizontal leg of L-shaped piece 54 of brackets 16 and 18 are configured to extend toward one another.

Tarpaulin 20 (FIG. 3) includes fabric body 62, cross bar coupling loops 64 and 66 defined on oppossed ends of body 62, fabric loop handles 68 and 70 sewn to the top face tarpaulin 20, centered thereon and near the outboard edge thereof, spaced apart flotation panels 72 and 74 included in body 62 adjacent to loops 64 and 66, zippered pocket 76, opposed flaps 78 and 80, hook-and-eye fasteners 82, and support leg storage straps 84 and 86.

Fabric body 62 is preferably composed of lightweight canvass or Acron synthetic fiber, but any lightweight, substantially waterproof fabric can be used.

Coupling loops 64 and 66 are sized to snugly but slidably receive cross bars 30 and 44 respectively therein.

Flaps 78 and 80 are extensions of fabric body 62 on opposed sides thereof. Conventional hook and eye fasteners are correspondently located and sewn to flaps 78 and 80 and to adjacent sections of fabric body 62. With this arrangement, flaps 78 and 80 can be folded over and secured against fabric body 62 as illustrated with flap 78 in FIG. 3.

Zippered pocket 76 includes clear, flexible, plastic material 88 sewn to fabric body 62 between flotation panels 72 and 74. Plastic material 88 includes zipper 90 which, when open, allows access to the interior of pocket 76.

Flotation panels 72 and 74 are preferably plastic covered styrofoam of sufficient size to allow canopy 10 with all of its components to float in the event canopy 10 falls in a body of water.

Storage straps 84 and 86 are attached near opposed ends of pocket 76 by button fasteners 92 and 94. The other ends of straps 84 and 86 include respective buttonholes 96 and 98 for receiving buttons 92, 94 in order to form a loop. Straps 84 and 86 when formed in loops are adapted for receiving support legs 32, 34, 46, and 48 therein.

Hook-shaped fasteners 100 couple one end each of connector straps 22-28 to support legs 32, 34, 46, and 48 respectively. The other ends of connector straps from 22-28 each also include a hook fastener 100. Straps 22-28 are preferably composed of rubber.

FIG. 1 illustrates the use of canopy 10 on a canoe 102. Coupling brackets 16 and 18 engage the exterior corner of side rails 104 and 106 of canoe 102. Hook fasteners 100 on exposed ends of fasteners 22 and 26 are hooked to the interior side of rails 104, 106 on the same side as brackets 16 and 18. Similarly, hook fasteners 100 of the exposed ends of connector straps 24 and 28 are hooked to the interior of rails 104 and 106 but on the side of brackets 16 and 18 opposed from connector straps 22 and 26. Canopy 10 is configured so that when connector straps 22-28 are connected as shown in FIG. 1, all four straps are under tension. This tension causes support members 12 and 14 to pivot away from one another about the pivot point of coupling brackets 16 and 18 whereby cross bars 30 and 44 move apart until restrained by tarpaulin 20 coupled therebetween. With this configuration, canopy 10 is securely held in the upright position by connectors 22-28 and tarpaulin 20 spans the gap between cross bars 30 and 44.

FIG. 1 also illustrates the particular advantages of canopy 10 when used on canoe 102. Tarpaulin 20 protects an occupant from exposure to direct rain and sunlight while providing an interior space free from support structures and other obstructions. Additionally, flaps 78 and 80 can be allowed to hang down to provide additional protection from the elements. Zippered pocket 76 is also advantageously located for convenient access by an occupant of canoe 102.

FIG. 7 illustrates canopy 10 encountering an overhanging tree limb 108 as the boat is moving forward. As cross bar 30 strikes limb 108, bar 30 is forced backward against the tension of connector straps 22 and 26. As this occurs, canopy 10 pivots backward about the pivotal connection of brackets 16 and 18. Fasteners 100 on connector straps 22 and 26 then slide along rails 104 and 106. When fasteners 100 slide to position approximately even with brackets 16 and 18, legs 32 and 34 are over center at this point, and tension on straps 22 and 26 pulls legs 32 and 34 backward and down so that canopy 10 collapses to the position shown in phantom lines in FIG. 7. In this way, significant damage to canopy 10 or boat 102 is avoided in that canopy 10 yields and collapses rather than bending, tearing, or ripping the coupling points between canopy 10 and boat 102. Additionally, this action prevents canopy 10 from causing boat 102 to hang up on limb 108 with the possibility that canoe 102 may be overturned and the occupants injured.

Figure 3:
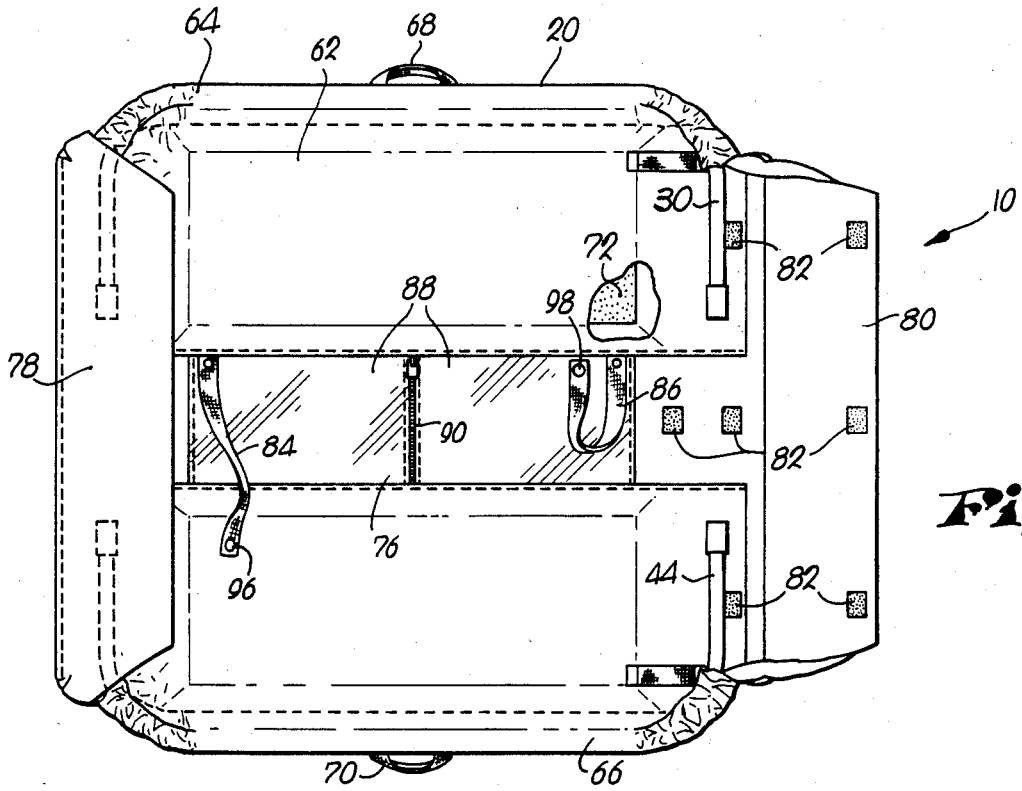
FIG. 3 is a plan view of the bottom side of the tarpaulin.

The portable storage position of canopy 10 is illustrated in FIG. 8. To achieve this configuration, canopy 10 is first removed from boat 102 by unhooking fasteners 100 from boat rails 104 and 106 after which canopy 10 is lifted from boat 102. Set screws 40 and 42 on couplers 36, 38, 50 and 52 are loosened and legs 32, 34, 46, and 48 detached. Canopy 10 is then placed on the ground exposed as shown in FIG. 3. Connector straps 22, 24, 26 and 28 are slipped off legs 32, 34, 46 and 48 and placed in zippered pocket 76.

Legs 32, 46, 34 and 48 along with coupling brackets 16 and 18 are then placed over storage straps 84 and 86. Straps 84 and 86 are looped over the support legs and buttonholes 96 and 98 engaged with fasteners 92 and 94 to thereby form a loop snugly securing legs 32, 34, 46, and 48. Cross bars 30 and 44 remain within coupling loops 64 and 66 but are turned to face inwardly. Flaps 78 and 80 are then folded over the ends of legs 32, 34, 46 and 48 with hook and eye fasteners 82 holding them in their folded positions. Handles 68 and 70 are grasped and lifted which causes tarpaulin 20 to fold about its longitudinal axis through pocket 76. The handles are then brought together to form the convenient carrying position illustrated in FIG. 8.

As one skilled in the art will appreciate, many uses and embodiments of canopy 10 are contemplated by the present invention. For example, canopy 10 is useful on other structures having an open top such as a tractor. Additionally, for example, support members 12 and 14 could be composed of wood or a variety of other rigid materials. Also for example, flotation panels 72 and 74 could advantageously be air inflatable pockets rather than the preferred plastic coated styroform. Finally, a fewer number of connector straps could be used connected on just one side of canopy 10 instead of the four preferred and these connector straps could be coupled at other functional locations on support members 12 and 14.

Having thus described the preferred embodiment of the present invention, what is claimed as new and desired to be secured Letters Patent is:

1. A canopy for use an open-topped vehicle such as a boat, tractor, or the like having two spaced-apart, substantially parallel, side rails, said canopy comprising:

first and second U-shaped support members each including a cross bar and first and second support legs;

first and second coupling means for pivotally intercoupling said first legs and said second legs respectively remote from said cross bars, said coupling means being adapted for coupling with the side rails, said cross bars being substantially parallel to one another, said coupling means allowing said bars to move alternately between spaced apart and adjacent positions relative to one another;

tarpaulin mean for intercoupling said bars, for limiting the distance said bars may spread apart, and for spanning the area therebetween; and connecting means including first and second resilient connectors coupled respectively with said first and second members, said connectors being adapted for slidably coupling with the side rails and being under resilient tension when so coupled, said canopy having an upright position when used on said vehicle whereby said first and second coupling means are coupled respectively to said side rails, said bars are in said spaced apart position with said tarpaulin spanning the area therebetween, said tarpaulin is substantially horizontal relative to said side rails, and said first and second connectors are coupled to said side rails on opposed sides respectively of said coupling means, said canopy having a collapsed position when used on said boat whereby said first and second coupling means are coupled respectively to the said side rails, said bars are in said adjacent position, and said members are resting on said side rails on the same side of said coupling means, said canopy being movable from said upright position to said collapsed position when an object strikes one of said bars.

2. The canopy as set forth in claim 1, said connecting means including third and fourth connectors coupled respectively with said first and second members, said first and second connectors being adapted for coupling said first and second members respectively with one of the side rails, said third and fourth connectors being adapted for coupling said first and second members respectively with the other of the side rails.

3. The canopy as set forth in claim 1, said connectors being flexible rubber straps.

4. The canopy as set forth in claim 1, said legs being detachable from said cross bars, said canopy having a handle, said tarpaulin capable of being folded, said canopy having a portable position whereby said tarpaulin is folded, said legs detached from said bars and contained within a fold of said tarpaulin, and said handle is exposed for grasping and lifting said canopy.

5. The canopy as set forth in claim 1, said tarpaulin means including flotation means for causing said canopy to float on a body of water.

6. The canopy as set forth in claim 5, said flotation means including flotation panels.

* * * * *